US005204727A

United States Patent [19]

Haneda et al.

[11] Patent Number: 5,204,727

[45] Date of Patent: Apr. 20, 1993

[54] IMAGE FORMING APPARATUS

[75] Inventors: Satoshi Haneda; Hisao Satoh; Tadayoshi Ikeda, all of Hachioji; Shizuo Morita, Tachikawa; Masakazu Fukuchi, Hachioji, all of Japan

[73] Assignee: Konica Corporation, Tokyo, Japan

[21] Appl. No.: 772,969

[22] Filed: Oct. 8, 1991

[30] Foreign Application Priority Data

Oct. 11, 1990 [JP] Japan ..... 2-272545
Oct. 11, 1990 [JP] Japan ..... 2-272547

[51] Int. Cl.[5] ..... G03G 21/00

[52] U.S. Cl. ..... 355/321; 271/263; 271/273; 271/292; 355/308; 355/322; 355/323

[58] Field of Search ..... 355/308, 309, 321-323; 271/288-294, 297, 298, 263, 273

[56] References Cited

U.S. PATENT DOCUMENTS 201,775 9/1887 Okada ..... 271/292
4,145,037 3/1979 Mol ..... 271/288 X
5,154,411 10/1992 Saito et al. ..... 271/289

FOREIGN PATENT DOCUMENTS 0357055 3/1990 European Pat. Off. ..... 271/292
0052357 5/1981 Japan ..... 271/292
0207361 11/1984 Japan ..... 271/293
0211060 11/1984 Japan ..... 355/323
0029765 2/1985 Japan ..... 355/323
0139867 6/1988 Japan ..... 271/289

*Primary Examiner*—A. T. Grimley
*Assistant Examiner*—Matthew S. Smith
*Attorney, Agent, or Firm*—Finnegan, Henderson, Farabow, Garrett & Dunner

[57] ABSTRACT

In an image forming apparatus, there is provided a multistage exit tray to receive printed recording sheets, which is located above an upper cover to access a conveyance path of the printed recording sheets within the apparatus by opening the upper cover upwardly. When the upper cover is opened, the exit tray is moved to a position where the exit tray does not interfere with the upper cover.

4 Claims, 10 Drawing Sheets

IMAGE FORMING APPARATUS

BACKGROUND OF THE INVENTION

The present invention relates to an electrophotographic type of color image forming apparatus such as a copier and a printer which forms a color image on a transfer sheet, and more particularly relates to an image forming apparatus, the paper discharge section of which can be provided with a multistage discharged paper tray, and further the image forming apparatus is provided with sorting function.

In general, in a digital type of image forming apparatus into which image data obtained by a separately provided image reading unit is inputted in order to record an image, the upper surface of the apparatus body is used for the paper discharge section onto which recorded transfer sheets are discharged, so that a discharged paper tray does not protrude outside the apparatus.

In the case of jam clearance or maintenance, the paper discharge section on the upper surface of the apparatus must be moved and withdrawn so that the conveyance passage of a transfer sheet can be opened. Consequently, the paper discharge section is rotatably provided to the apparatus body through a hinge.

When a multistage discharged paper tray is installed in the apparatus in order to provide it with sorting function, the motion of the paper discharge section is interrupted by the multistage discharged paper tray, so that it is necessary to remove the discharged paper tray each time when a jammed transfer sheet is removed or maintenance of the apparatus is conducted.

In order to provide an image forming apparatus with sorting function, as is widely known, a multistage discharged paper tray is used in order to sort discharged transfer sheets at each page or at each volume.

In order to reduce the space, or for the reason of the structure of the discharged paper tray, the discharged paper tray is composed in such a manner that: the components of the discharged paper tray are vertically piled up, leaving small gaps so that transfer sheets can be stacked in the gaps.

Accordingly, the intervals between the components of the discharged paper tray become extremely narrow, so that an operator must pick up the transfer sheets with his fingers. Accordingly, its operability is usually low.

SUMMARY OF THE INVENTION

The first object of the present invention is to provide an image forming apparatus in which jam clearance and maintenance can be easily conducted even when a multistage discharged paper tray for sorter use is installed in the apparatus.

The second object of the present invention is to provide an image forming apparatus which is composed in such a manner that the posture of the discharged paper tray can be changed so that the transfer sheets can be easily taken out from the tray.

The first structure of the image forming apparatus of the present invention is as follows: the image forming apparatus has a multistage discharged paper tray on the upper portion of the upper lid, wherein the paper conveyance region can be opened when the aforementioned upper lid is opened upward; and when the aforementioned upper lid is opened upward, the aforementioned discharged paper tray is moved to a position where the discharged paper tray does not interfere with the operation.

The second structure of the present invention is composed of: the first process in which a plurality of discharged paper trays are provided, onto which printed papers are discharged; and the second process in which the discharged paper tray from which printed papers have been discharged, is tilted in the paper-take-out-direction.

DESCRIPTION OF THE PREFERRED EMBODIMENT

An embodiment of the image forming apparatus of the present invention is shown in FIG. 1 to FIG. 4.

Figure 1:
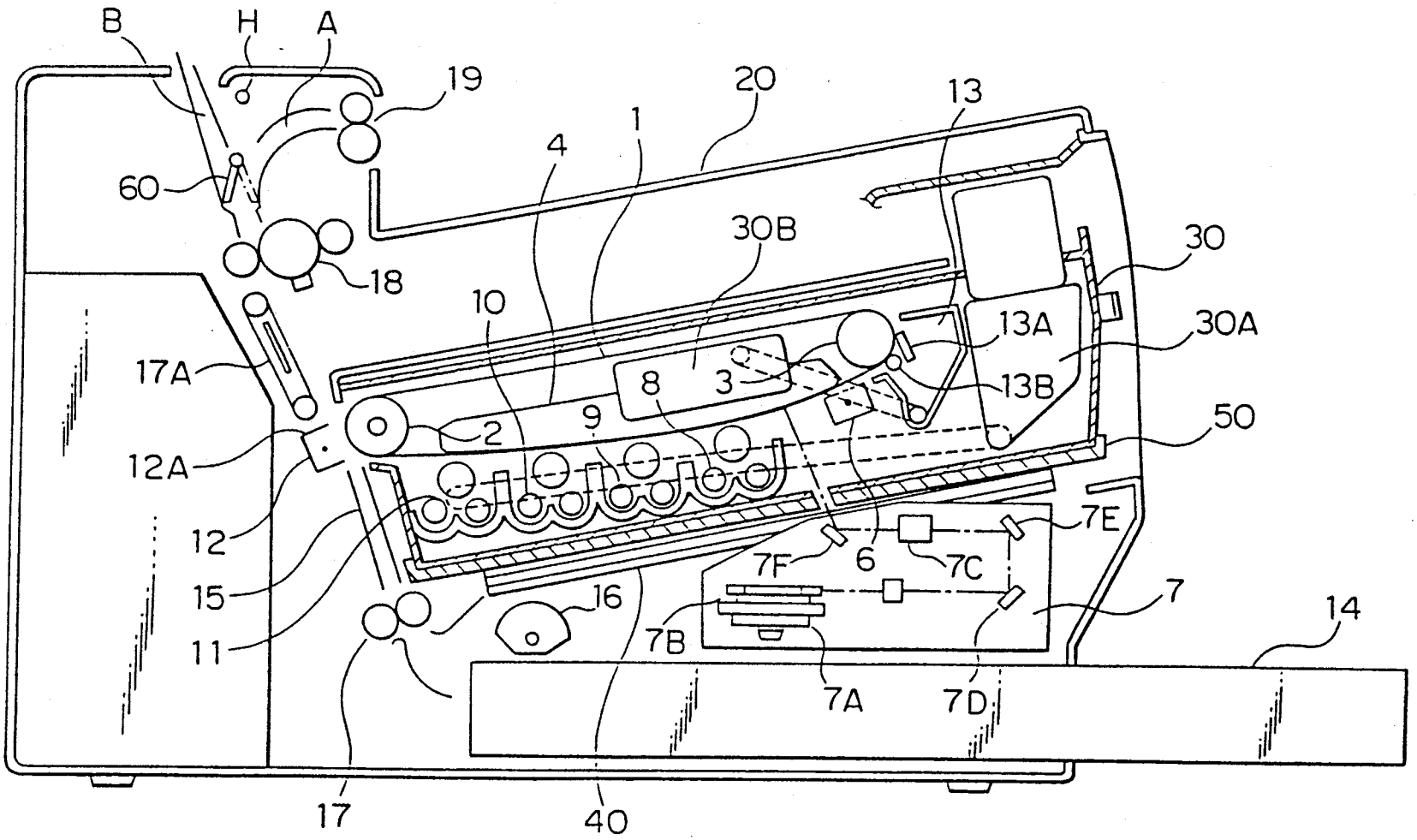
FIG. 1 is a sectional view of the image forming apparatus of the present invention.

In FIG. 1, numeral 1 is a flexible photoreceptor belt which is a belt-shaped image carrier. The photoreceptor belt 1 is provided between rotating rollers 2 and 3, and when the rotating roller 2 is driven, the photoreceptor belt 1 is conveyed clockwise.

Numeral 4 is a guide member which is fixed to an apparatus body in such a manner that the guide member 4 touches internally on the aforementioned photoreceptor belt 1. The aforementioned photoreceptor belt 1 is tensed since the rotating roller 3 is pushed outside, so that the inner peripheral surface of the photoreceptor belt 1 is slidably contacted with the aforementioned guide member 4.

Consequently, even while the aforementioned photoreceptor belt 1 is being rotated, the photoreceptor on the outer peripheral surface of the photoreceptor belt 1 can be maintained at a constant position with regard to the surface of the aforementioned guide member 4, so that a stable image forming surface can be formed on the photoreceptor belt 1.

Numeral 6 is a scorotron charging unit which is used for a charging means. Numeral 7 is a laser writing system unit which is an image exposure means. Numerals 8–11 are a plurality of developing units. These image forming means are installed in the apparatus in such a manner that: the image forming means are opposed to the outer peripheral surface of the aforementioned photoreceptor belt 1, the back of which is opposed to the guide member 4.

The aforementioned laser writing system unit 7 is housed in a housing 70 which is provided with a slit-shaped opening 70A used for exposure, and the housing 70 is assembled into the apparatus body.

Other than the optical system shown in the drawing, an optical system in which a light emitting section and a convergent photoconductor are combined into one unit, is also used for the aforementioned laser writing system unit 7.

The aforementioned developing units 8, 9, 10, 11 contain toners of, for example, yellow, magenta, cyan and black. The developing units are provided with developing sleeves which is located in such a manner that the gap between the aforementioned photoreceptor belt and the developing sleeve is maintained to be a predetermined value, and a latent image formed on the photoreceptor belt 1 is developed into a visual image by means of a non-contact developing method. This non-contact developing method is advantageous in that: the movement of the photoreceptor belt is not obstructed by the developing unit, which is different from the contact developing method.

Numeral 12 is a transfer unit, numeral 12A is a discharge bar, and numeral 13 is a cleaning unit, wherein a blade 13A of the cleaning unit 13 and a cleaning roller 13B are maintained to be in a position separated from the surface of the photoreceptor belt 1 while image formation is being conducted. The blade 13A and the conveyance roller 13B are contacted with the surface of the photoreceptor belt 1 with pressure only when a cleaning operation is conducted after an image has been transferred.

The color image forming process conducted by the aforementioned color image forming apparatus will be described as follows.

In this embodiment, a multi-color image is formed according to the following image formation system. Data obtained by a color image data input section in which an original image is scanned by an image pick-up element, is processed by an image data processing section so that image data can be made. The image data obtained in the manner described above, is once stored in an image memory. When recording is conducted, the stored image data is called out from the image memory, and inputted into a recording section, for example, the color image forming apparatus shown in FIG. 1.

When a color signal outputted from the image reading unit, which is different from the aforementioned printer, is inputted into the aforementioned laser writing system unit 7, a laser beam generated by a semiconductor laser (not shown in the drawing), is rotationally scanned by a polygonal mirror 7B which is rotated by a driving motor 7A, and then the laser beam passes through an $f\theta$-lens 7C, and the optical path of the laser beam is curved by mirrors 7D, 7E, 7F. After that, the laser beam forms a bright line projected on the surface of the photoreceptor belt 1 onto which an electrical charge has been previously given by the charging unit 6.

When scanning has been started, the laser beam is detected by an index sensor, and beam modulation conducted by the first color signal is started, and then the modulated beam scans the surface of the aforementioned photoreceptor belt 1. Accordingly, a latent image corresponding to the first color is formed on the surface of the photoreceptor belt 1 by the primary scanning conducted by the laser beam, and by the auxiliary scanning conducted by the conveyance of the photoreceptor belt 1. This latent image is developed by the developing unit 8 which is loaded with yellow toner so that a yellow (Y) toner image is formed on the surface of the photoreceptor belt. While the obtained toner image is being held on the belt surface, it passes under the cleaning unit 13, and the apparatus starts the next image formation.

The aforementioned photoreceptor belt 1 is charged again by the aforementioned charging unit 6, and then the second color signal outputted from the signal processing section is inputted into the aforementioned writing system unit 7. In the same manner as the first color signal, a writing operation is conducted on the surface of the photoreceptor belt so that a latent image can be formed. The latent image is developed by the developing unit 9 which is provided with the toner of magenta (M), the second color.

This magenta (M) toner is formed on the yellow (Y) toner which has been already formed.

Numeral 10 is a developing unit which is loaded with cyan (C) toner. The developing unit 10 forms a toner image of cyan (C) on the surface of the photoreceptor belt according to a control signal generated by the signal processing section.

Numeral 11 is a developing unit which is loaded with black toner. In the same manner as described above, a black toner image is formed on the surface of the photoreceptor belt so that it can be registrated on the toner image previously formed. A DC and/or AC bias is applied to the sleeves of the developing units 8, 9, 10, 11, and jumping development is conducted by two component developer, so that non-contact development is conducted on the photoreceptor belt 1, the base of which is grounded. One component developer can be also applied to the apparatus of the present invention.

The color toner image formed on the surface of the photoreceptor belt 1 in the manner described above, is transferred onto a transfer sheet which has been conveyed from a paper feed cassette 15 through a paper feed guide 15.

The uppermost transfer sheet of a stack provided on a paper feed cassette 14, is conveyed when a paper feed roller 16 is rotated, and the conveyed transfer sheet is supplied to a transfer unit 12 by a timing roller 17 being timed to the image formation on the photoreceptor belt 1.

After the toner image has been transferred onto the transfer sheet, the transfer paper is discharged and positively separated from the photoreceptor belt 1 which is sharply curved by the aforementioned rotating roller 2. Then, the transfer sheet is conveyed upward by a suction type of conveyance belt 17A, and the toner image on the transfer sheet is thermally fixed. After that, the transfer sheet is discharged onto a tray formed on an upper lid 20, through a paper discharge roller 19.

On the other hand, after the toner image has been transferred onto the transfer sheet, the photoreceptor belt 1 is further rotated, and the residual toner is removed by the aforementioned cleaning unit 13 in which the blade 13A and the toner cleaning roller 13B are contacted with the photoreceptor belt 1. After the cleaning, the aforementioned blade 13A is separated from the photoreceptor belt 1. A little after that, the toner cleaning roller 13B levels the toner accumulated on the tip of the blade 13A, and then the toner cleaning roller 13B is separated from the photoreceptor belt 1. After that, a new image forming process is started.

The aforementioned photoreceptor belt 1 is integrally provided to the process cartridge 30 together with the charging unit 6 and the developing units which are provided in the lower periphery, and together with the cleaning unit 13 which is provided in the end portion with regard to the lateral direction.

The aforementioned process cartridge 30 is provided with a developer supply section 30A which supplies toner to each developing unit, and provided with a used toner cartridge 30B which recovers used toner removed by the cleaning unit 13. The aforementioned process cartridge 30 is set on a carriage 50 which moves on a guide rail 40 provided in the apparatus, and slid into the apparatus along the guide rail 40 from the right upper position in FIG. 1.

Accordingly, the process cartridge 30 can be easily pulled out from the apparatus body together with the aforementioned carriage 50, and the transfer section can be opened so that maintenance of parts, toner supply and discharge of used toner can be conducted.

The aforementioned upper lid 20 can be fully opened counterclockwise through hinge H. When the upper lid 20 is opened, the upper members of discharged paper passage A and paper discharge roller 19 which are provided integrally with the upper lid 20, are moved so that the conveyance passage of the transfer sheet can be opened.

As described above, when the process cartridge 30 is removed and the upper lid 20 is opened, the transfer sheet conveyance region including the transfer section can be fully opened, so that a jammed sheet can be easily removed, and a cleaning or maintenance operation can be easily conducted.

Further, the aforementioned apparatus is provided with paper discharge passage B which is changed over when a guide member 60 is rotated, as well as the aforementioned paper discharge passage A. Accordingly, it is possible to discharge a transfer sheet onto which an image has already been fixed, to a paper discharge unit having sorting function, through the aforementioned paper discharge passage B.

Figure 2A:
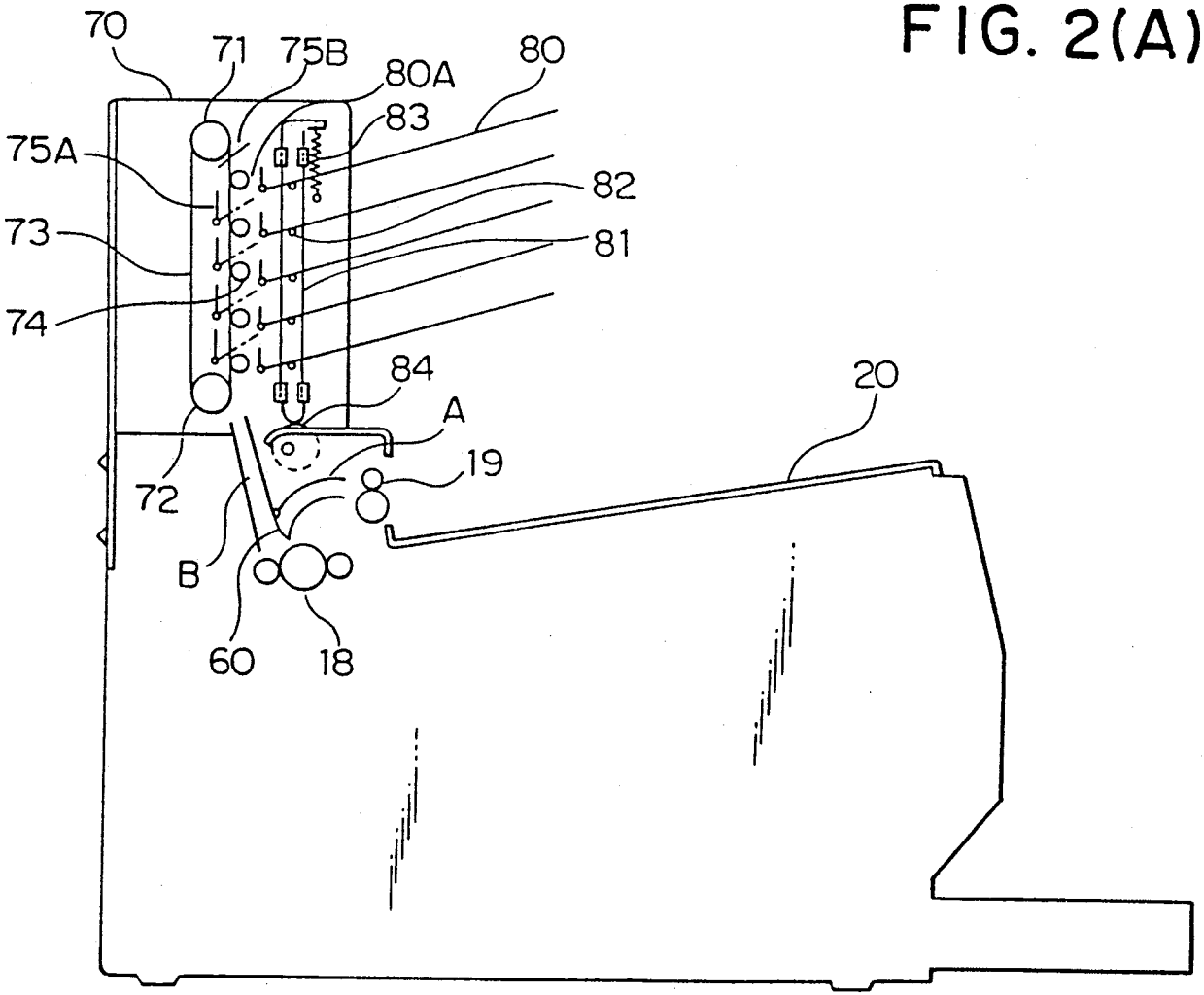
FIGS. 2(*a*) and (*b*), FIGS. 3(*a*) and (*b*)

In FIG. 2(A), there is shown a paper discharge unit 70 which is integrally provided to the apparatus body.

In the aforementioned paper discharge unit 70, a transfer sheet is conveyed as follows: when the guide member 60 is changed over, the transfer sheet is discharged into paper discharge passage B; and the transfer sheet is pinched by a plurality of conveyance belt 73, which is stretched between a drive roller 71 rotating counterclockwise and an idle roller 72, and a plurality of press roller 74 which comes into contact with the conveyance belt 73, so that the transfer sheet is conveyed vertically.

Next, the transfer sheet bumps against a sorting plate 75A which is rotated as shown by a one-dotted chain line, being timed with the discharge of the transfer sheet corresponding to the selection of the paper discharge mode, and then the direction of the transfer sheet is changed so that the transfer sheet is discharged onto a predetermined discharge tray 80 and sorted at each page or each volume.

Each discharge tray of the aforementioned multistage discharge tray 80, is supported by a rotatable support shaft 80A and a support pin 82 provided on a slide plate 81 which can be moved vertically. By the force of a tension spring 83, the lower end of the aforementioned slide plate 81 is contacted with the peripheral surface of an eccentric cam 84 which is fixed to the same shaft as that of the aforementioned hinge H.

Figure 2B:
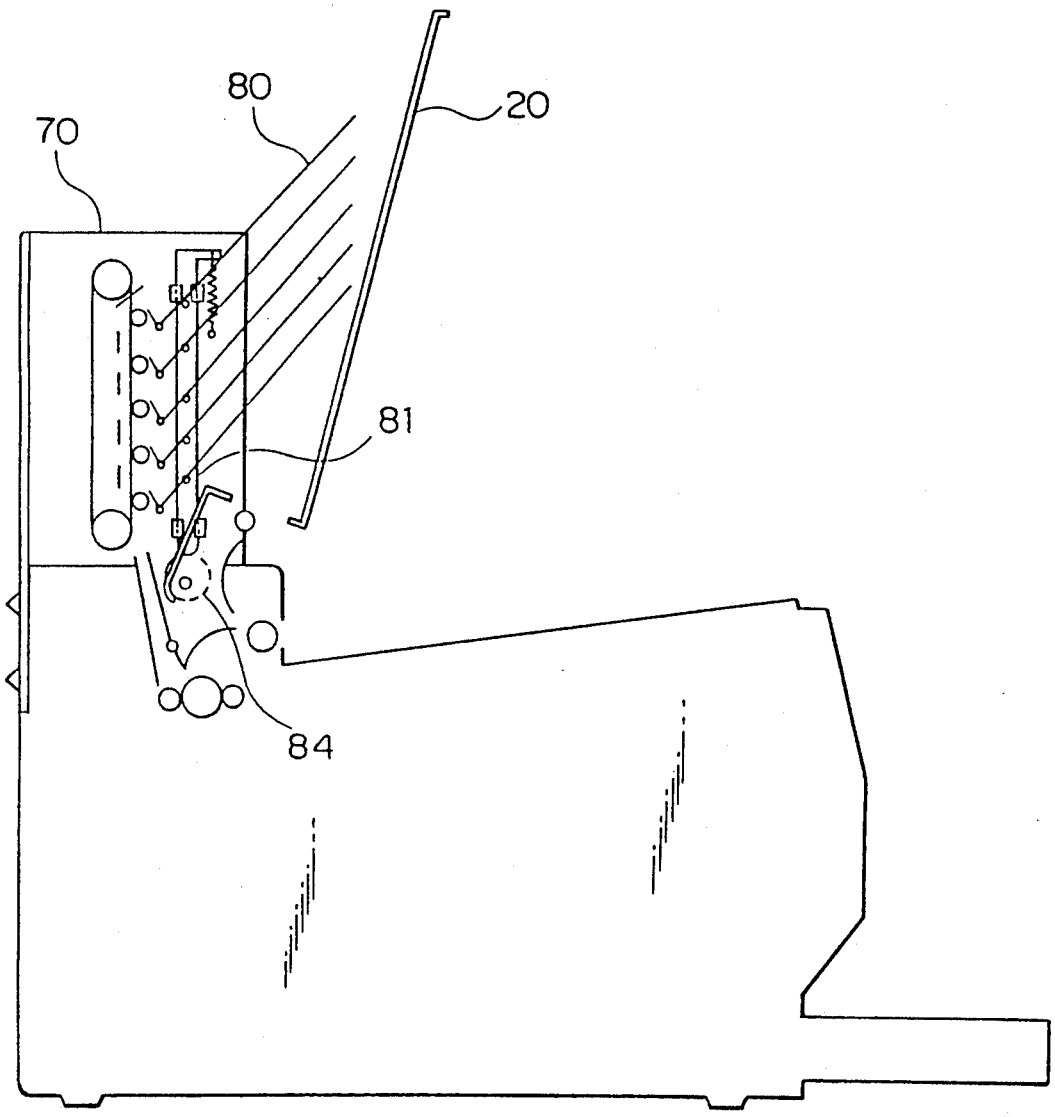

Accordingly, when the aforementioned upper lid 20 is opened in the process of jam clearance as illustrated in FIG. 2(B), the aforementioned eccentric cam 84 is rotated and the aforementioned slide plate 81 is raised, so that the paper discharge trays 80 are rotated and folded counterclockwise all at once. In the manner described above, the discharge trays 80 are moved and withdrawn from the upper portion of the upper lid 20.

As a result, each discharge tray 80 is moved to a position where the discharge tray 80 does not interfere with the movement of the upper lid 20, so that the upper lid 20 can be opened without any problem.

Figure 3A:
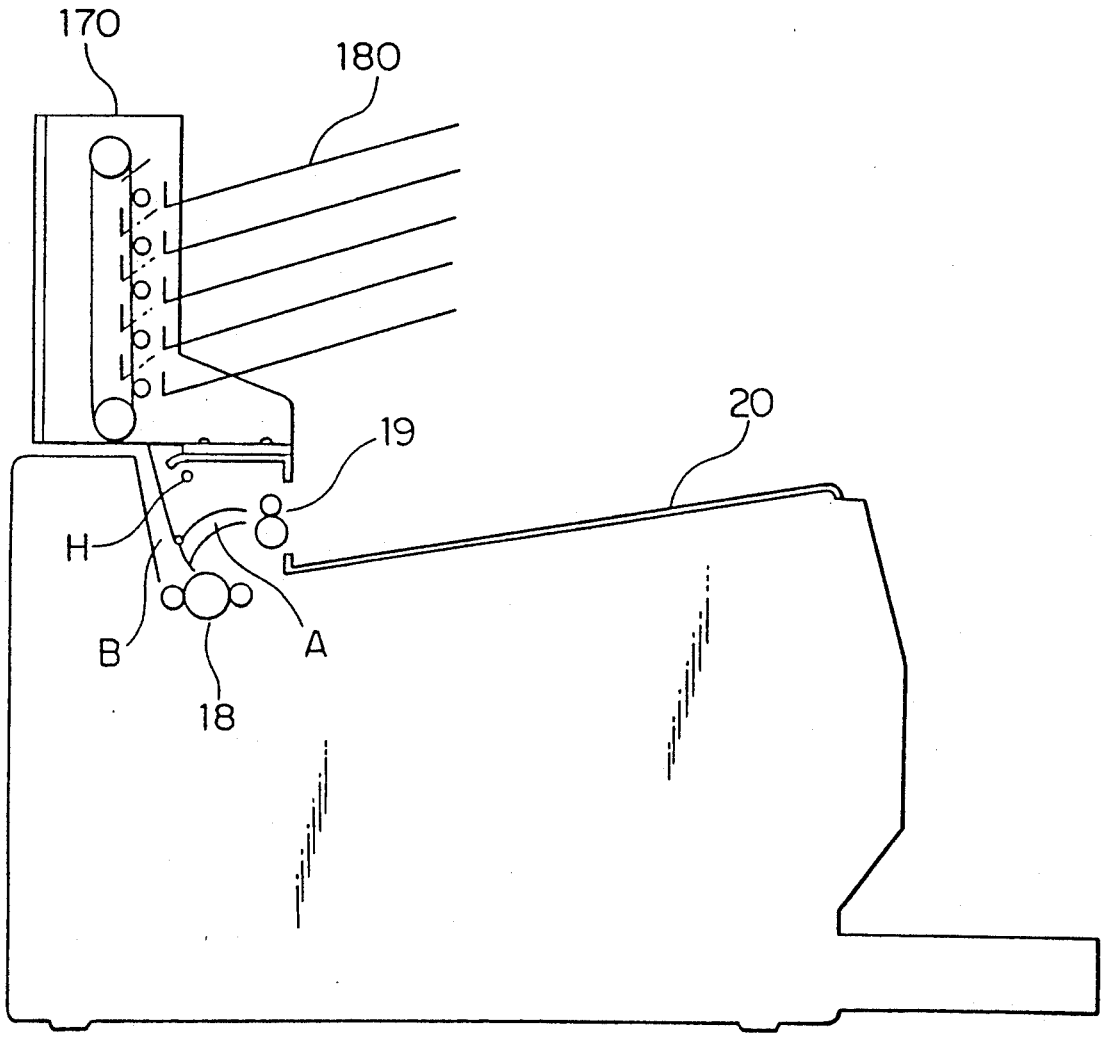

FIG. 3(A) shows an embodiment in which a paper discharge unit 170 is provided integrally with the upper lid 20.

Figure 3B:
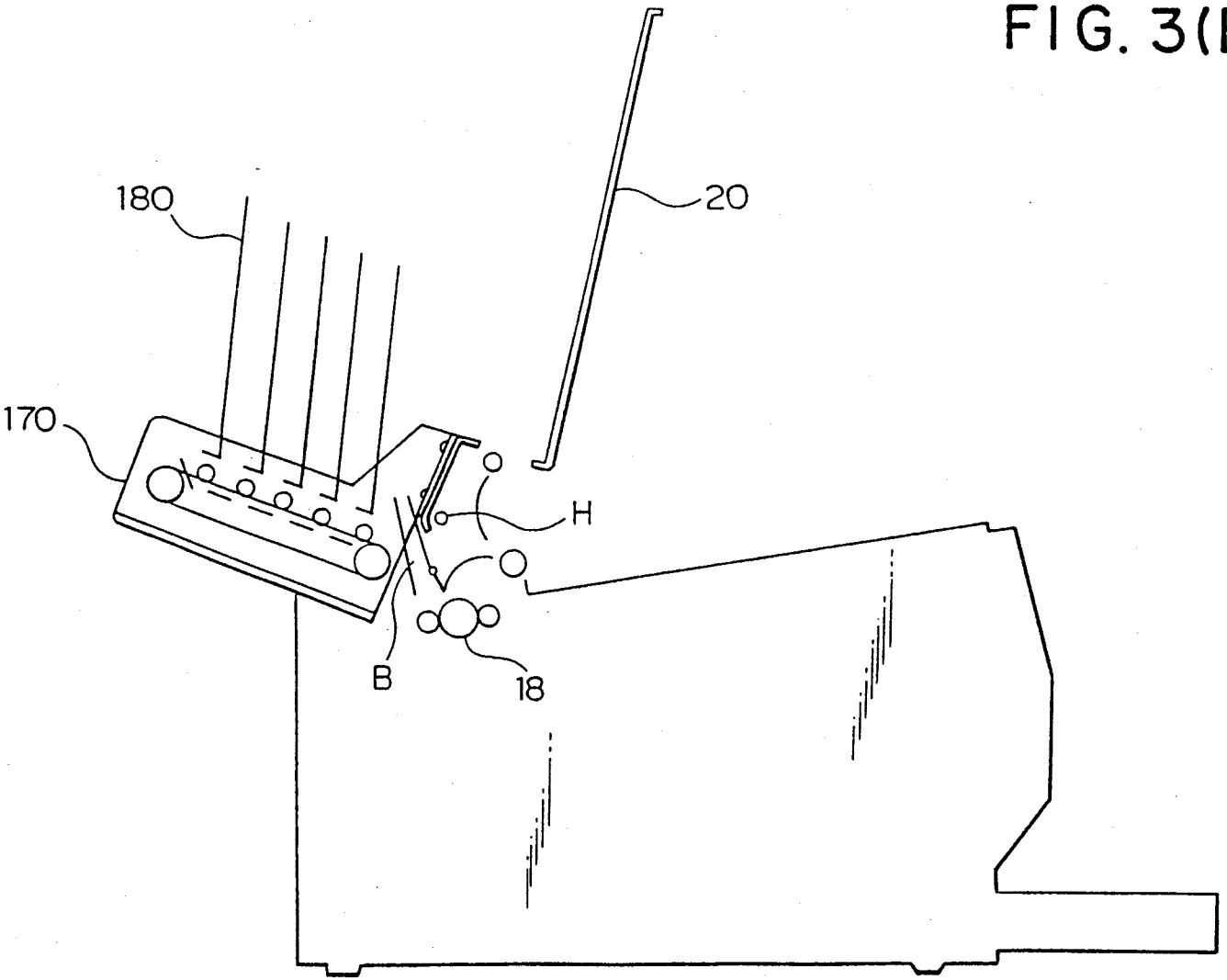

In this case, it is not necessary for the discharge trays 180 to be rotated as in the aforementioned case, so that they are fixed to the upper lid, and the discharge unit 170 itself is rotated and opened together with the upper lid 20 as illustrated in FIG. 3(B). Consequently, each discharge tray 180 can be always maintained in a position where the discharge tray does not interfere with the motion of the upper lid 20.

Figure 4:
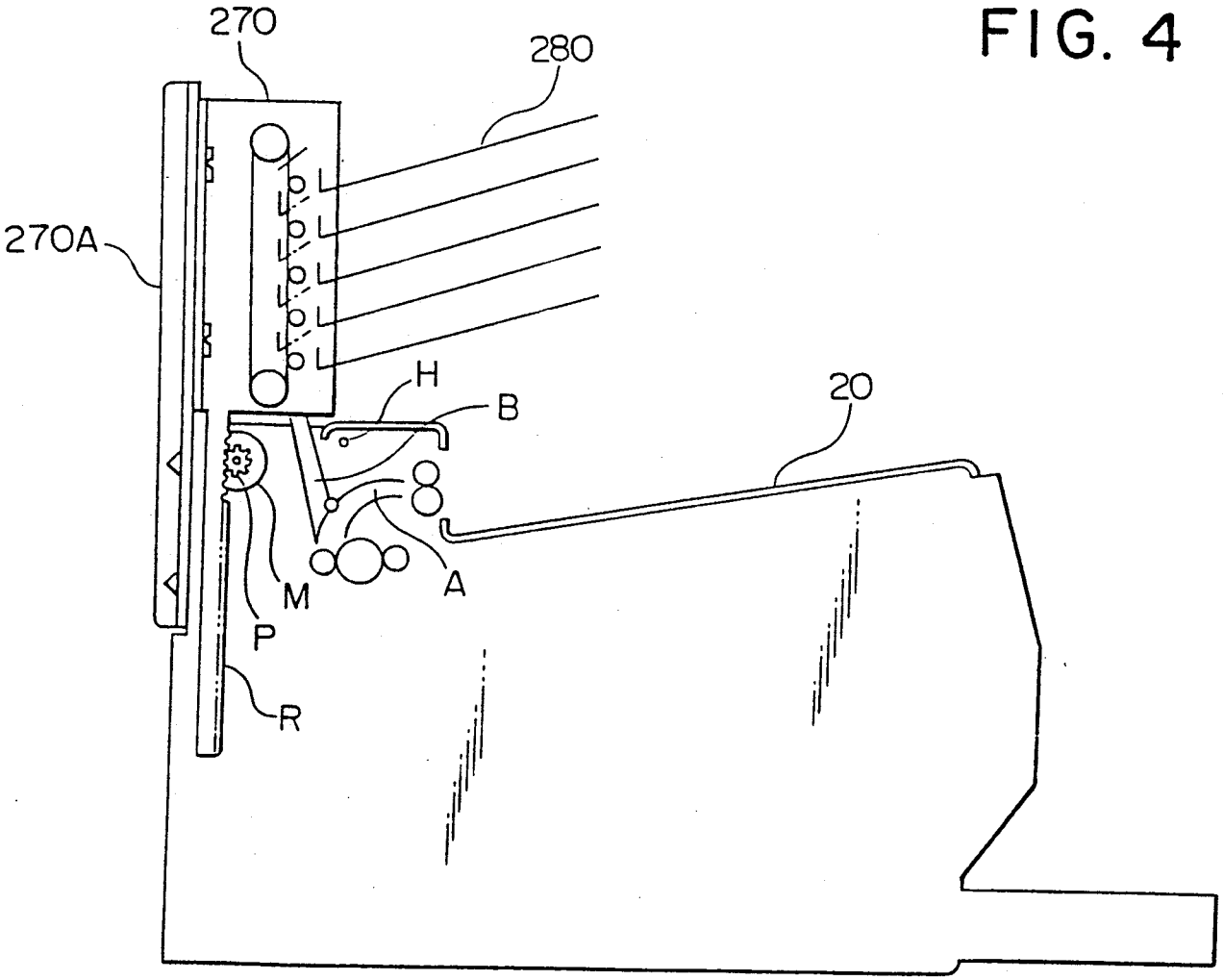
FIG. 4 are sectional views showing the essential portions of the aforementioned apparatus.

In FIG. 4, there is shown an embodiment in which a paper discharge unit 270 is supported by the apparatus body, and the paper discharge unit 270 is moved upward so that the paper discharge trays 280 can be moved to a position where it can not interfere with the motion of the upper lid 20.

In this embodiment, in the initial stage of the opening operation of the upper lid 20, motor M starts to rotate, and the force is transmitted to the paper discharge unit 270 through pinion P and rack R so that the paper discharge unit 270 can be slid upward on a base plate 270A. After the upper lid 20 has been closed, the aforementioned motor M is reversed and the paper discharge unit 270 is returned to the position illustrated in the drawing.

It is possible to horizontally move the paper discharge trays to the left of the apparatus by the same mechanism as described above so that the paper discharge trays can be withdrawn to the position where they do not interfere with the motion of the upper lid 20.

In FIGS. 5(A), 5(B), 6(A), 6(B), there is shown another embodiment of the image forming apparatus of the present invention. The composition of this embodiment is the same as that of the embodiment shown in FIG. 1. The aforementioned apparatus is provided with paper discharge passage B which is changed over when a guide member 60 is rotated, as well as the aforementioned paper discharge passage A. Accordingly, it is possible to discharge a transfer sheet onto which an image has already been fixed, to a paper discharge unit having sorting function, through the aforementioned paper discharge passage B.

In FIGS. 5(A), 5(B), 6(A), 6(B), there is shown a paper discharge unit in which the posture of the paper discharge unit can be changed over into the first and the second process, wherein in the first process, the posture of the paper discharge tray is suitable for discharge of a print paper, that is, a transfer sheet on which an image has been fixed, and in the second process, the paper discharge tray is tilted so that the transfer sheet can be taken out.

Figure 5A:
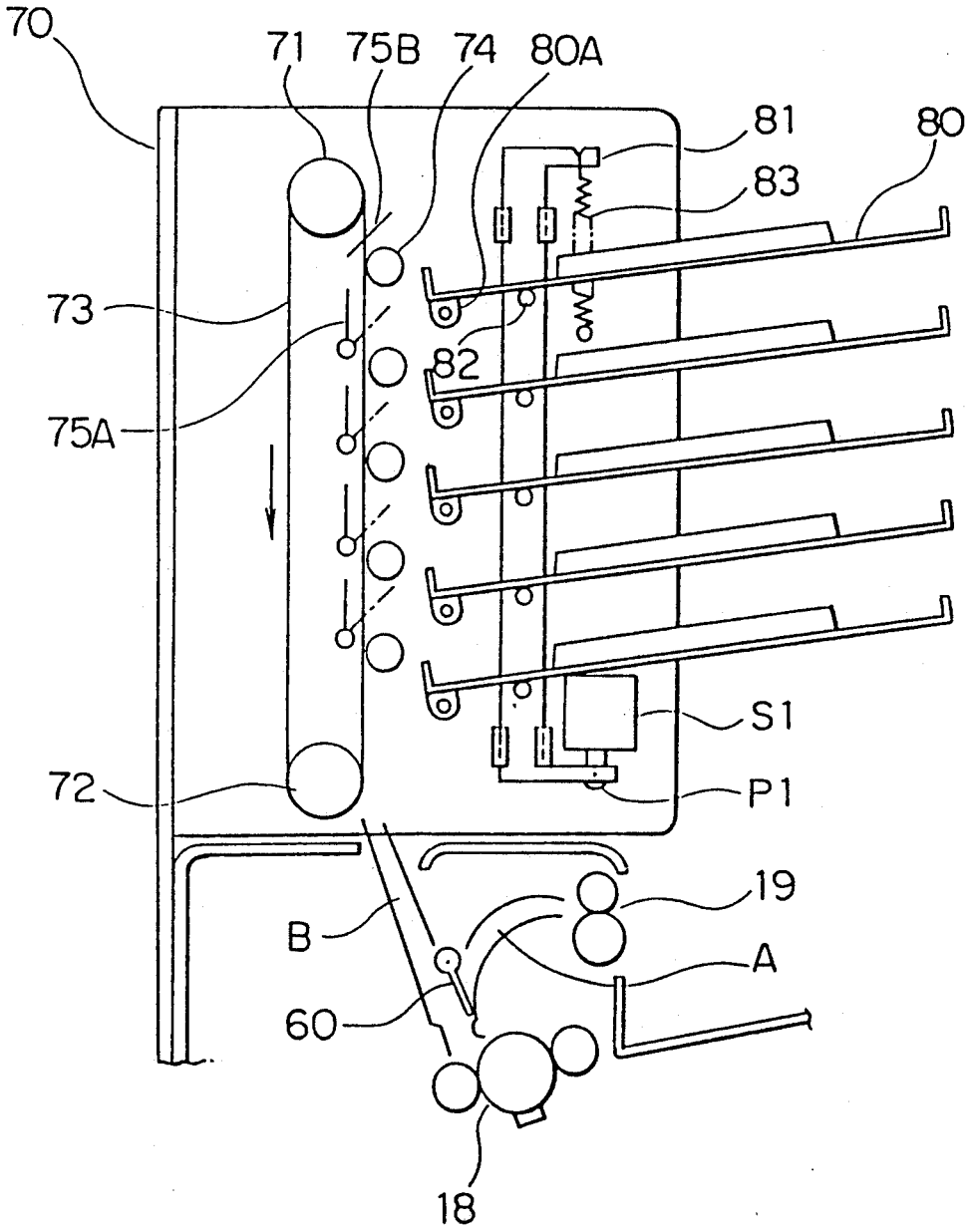
FIGS. 5(*a*) and (*b*) and FIGS. 6(*a*) and (*b*) are sectional views showing the essential portions of the aforementioned apparatus of another embodiment.
Figure 5B:
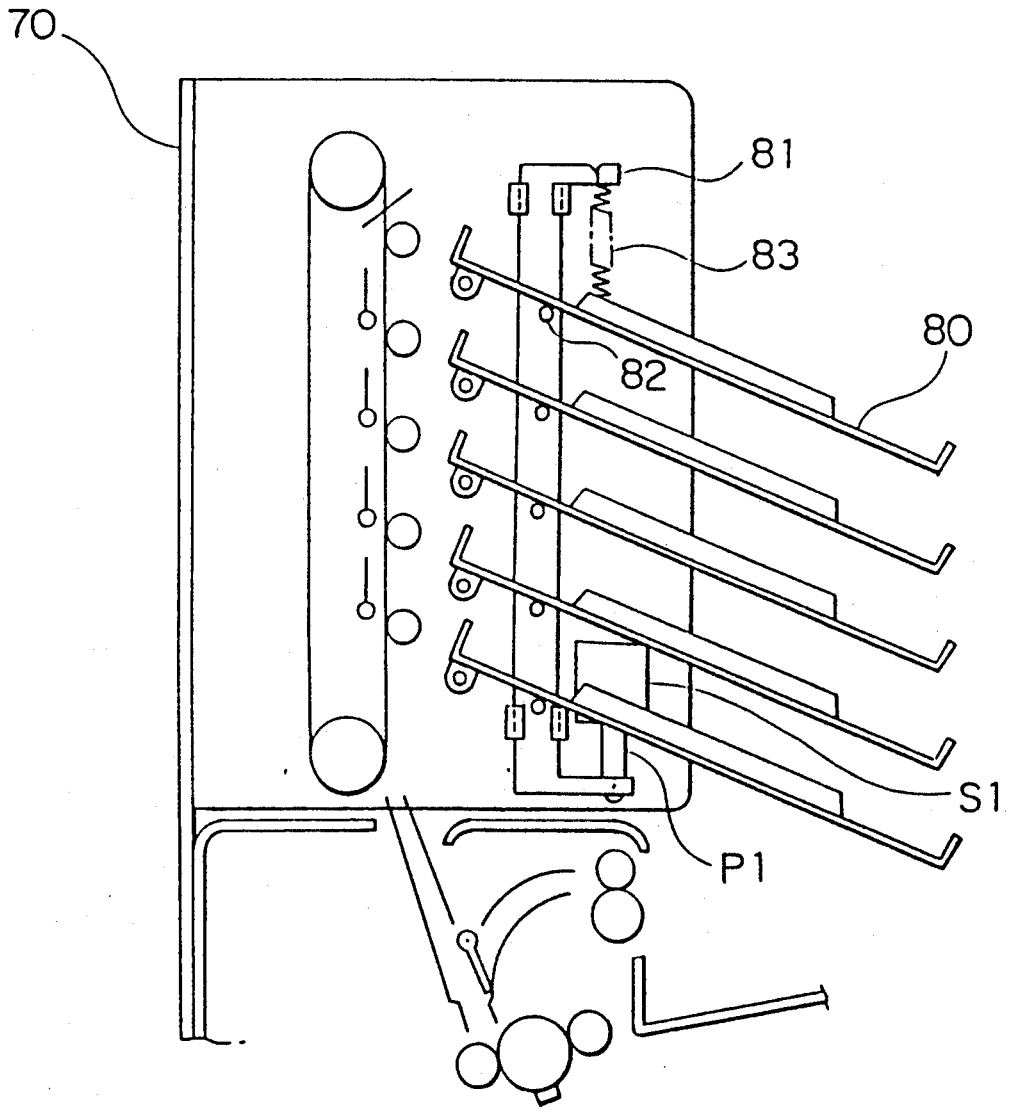

FIGS. 5(A), 5(B) show the case in which transfer papers can be taken out from the tray to the right in the drawings. These drawings show the paper discharge unit 70 characterized in that: after transfer sheets have been discharged, the discharge trays are tilted in the direction of discharge so that the transfer sheets can be easily taken out from the discharge tray.

In the aforementioned paper discharge unit 70, a transfer sheet is conveyed as follows: when the guide member 60 is changed over, the transfer sheet is discharged into paper discharge passage B; and the transfer sheet is pinched by a plurality of conveyance belt 73, which is stretched between a drive roller 71 rotating counterclockwise and an idle roller 72, and a plurality of press roller 74 which comes into contact with the conveyance belt 73, so that the transfer sheet is conveyed vertically.

Next, the transfer sheet bumps against a sorting plate 75A which is rotated as shown by a one-dotted chain line, being timed with the discharge of the transfer sheet corresponding to the selection of the paper discharge mode, and then the direction of the transfer sheet is changed so that the transfer sheet is discharged onto a predetermined discharge tray 80 and sorted at each page or each volume.

Each discharge tray of the aforementioned multistage discharge tray 80, is supported by a rotatable support shaft 80A and a support pin 82 provided on a slide plate 81 which can be moved vertically.

Previously to the start of paper discharging, solenoid S1 is changed over to ON, and then the aforementioned sliding plates 81 is raised as shown in FIG. 5(A) due to the attraction of plunger P1. As a result, each support pin 82 pushes each paper discharge tray 80 so that the paper discharge tray 80 can be set slightly upward. Accordingly, discharged papers can be positively put onto the tray and stacked.

Synchronously with the end of paper discharging, the aforementioned solenoid S1 is changed over to OFF so that plunger P1 can be released. As a result, the aforementioned sliding plates 81 are pulled by the tension spring 83 and lowered as shown in FIG. 5(B). Accordingly, each support pin 82 is lowered so that each paper discharge tray 80 can be set downward with regard to the paper discharging direction. Accordingly, discharged papers are moved to the tip portions of the trays 80 so that they can be easily removed.

The inclined angle of the tray is preferably 10°–45° with regard to the horizontal surface.

FIG. 6 shows a paper discharging unit 170 characterized in that: after transfer sheets have been discharged onto the paper discharge tray, the paper discharge tray is tilted in the direction perpendicular to the paper discharging direction, so that the transfer sheets can be easily removed from the tray by an operator who are on the front side of the apparatus.

A paper discharge tray 180 is supported as follows: a bearing hole on a front base board 170A side is supported by a bearing pin 185 disposed on a slide plate 184 (shown by a one-dotted line) which can be slid vertically inside the front base board 170A; a bearing hole on a rear base board 170B side is rotatably supported by a support pin (not shown in the drawing) fixed to the rear base board 170B; and further the paper discharge tray 180 is supported by a support pin 182 on a slide plate 181 which can be moved vertically.

Figure 6A:
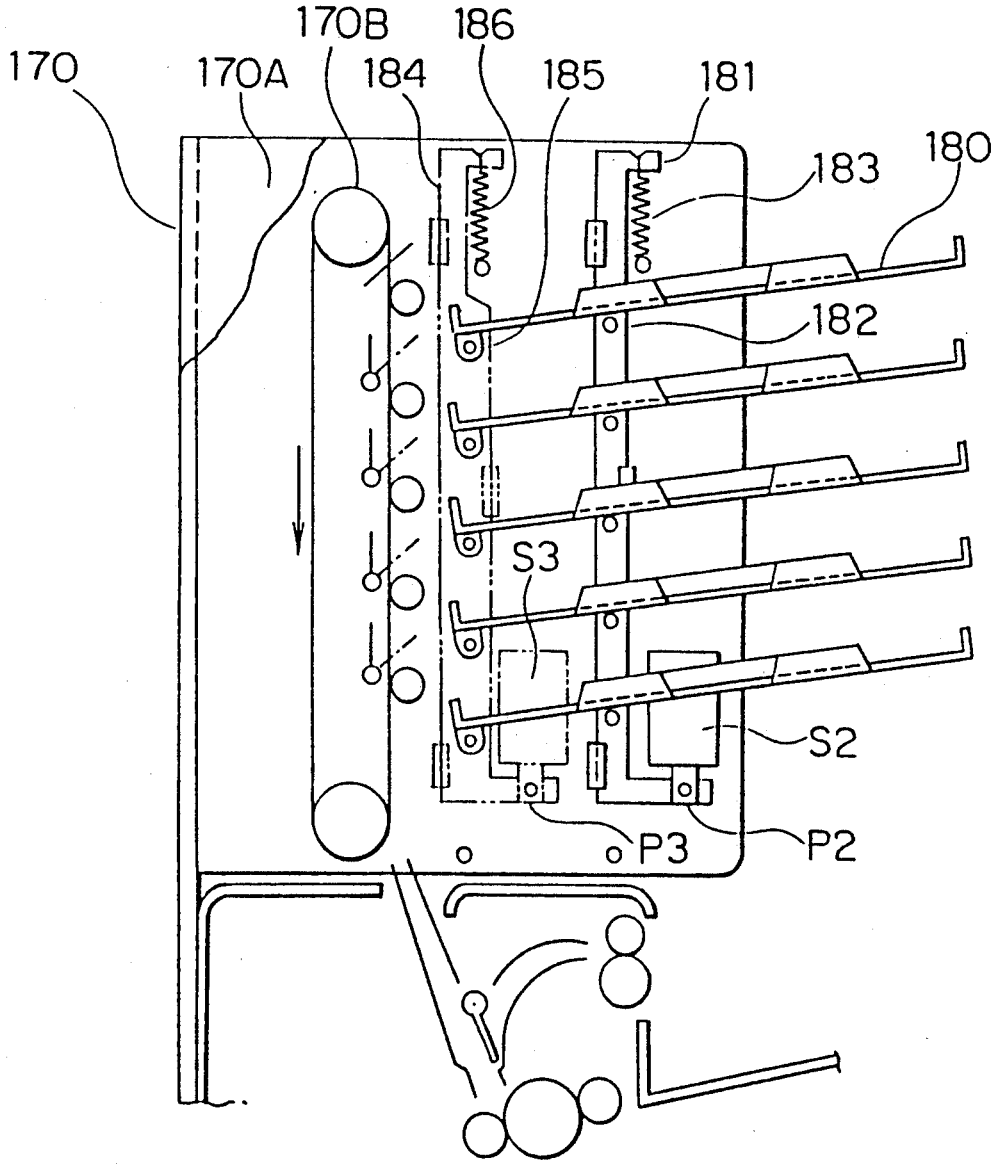

Previously to paper discharging, solenoids S2 and S3 are changed over to ON, and plungers P2 and P3 are operated so that the aforementioned slide plates 181, 184 can be raised as shown in FIG. 6(A). As a result, the aforementioned bearing hole 185 is moved upward so that every bearing hole can be maintained horizontally, and further the aforementioned the support pin 182 is moved upward so that the paper discharge tray 180 can be set slightly upward.

Figure 6B:
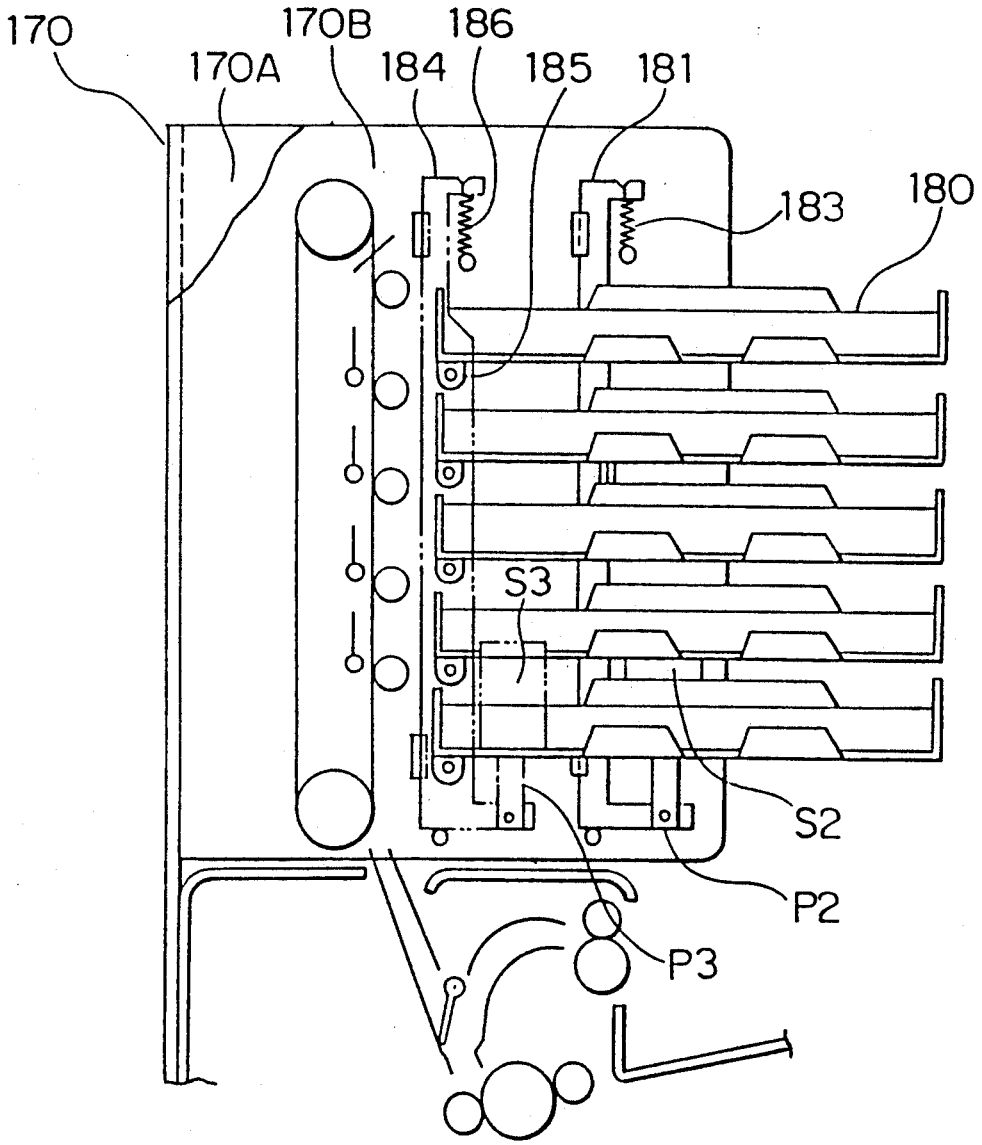

When paper discharging motion has been finished, the aforementioned solenoids S2 and S3 are changed over to OFF so that plungers P2 and P3 can be released. Accordingly, the aforementioned slide plates 181, 184 are lowered downward by the force of tension springs 183, 186 as illustrated in FIG. 6(B). As a result, both the aforementioned bearing support pin 185 and the support pin 182 are moved downward so that the paper discharge tray is set horizontally, and at the same time the tray is tilted to the front side so that the transfer sheets can be easily removed from the tray.

The inclined angle of the tray is preferably 10°–45° with regard to the horizontal surface.

According to the present invention, it is possible to provide a paper discharging unit having sorting function in the upper portion of the apparatus body. As a result, a compact image forming apparatus having various function can be provided in which jam clearance and maintenance can be easily conducted and practicability is high.

Further, in the apparatus of the present invention, it is easy to handle transfer sheets which have been discharged onto multi-stage paper discharge trays. As a result, in the image forming apparatus of the present invention, even an unskilled operator can efficiently handle copying papers even when he is in a normal operating position.

What is claimed is:

1. An image forming apparatus comprising:

(a) an upper cover being upwardly openable to access a recording sheet conveyance path within said apparatus;

(b) a multistage exit tray means, disposed above said upper cover, for receiving recording sheets after image formation, said multistage exit tray means including means for withdrawing said exit tray means from an interference position with said upper cover when open; and (c) means for automatically operating said withdrawing means in accordance with the opening of said upper cover.

2. The apparatus of claim 1, wherein withdrawing means includes means for withdrawing said multistage exit tray means upwardly.

3. The apparatus of claim 1, wherein withdrawing means includes means for withdrawing each stage of said multistage exit tray means by a rotating movement.

4. The apparatus of claim 1, wherein withdrawing means includes means for withdrawing said multistage exit tray means by rotating it as a unit.

* * * * *